United States Patent [19]

Bergman

[11] Patent Number: 4,581,046

[45] Date of Patent: Apr. 8, 1986

[54] DISK FILTER

[75] Inventor: Werner Bergman, Pleasanton, Calif.

[73] Assignee: The United States of America as represented by the United States Department of Energy, Washington, D.C.

[21] Appl. No.: 690,023

[22] Filed: Jan. 9, 1985

[51] Int. Cl.[4] ..... B03C 3/62

[52] U.S. Cl. ..... 55/131; 55/150; 55/484

[58] Field of Search ..... 55/6, 130–132, 55/143, 145, 146, 150, 154, 155, 484

[56] References Cited

U.S. PATENT DOCUMENTS 3,915,676 10/1975 Reed et al. ..... 55/131
4,200,440 4/1980 Renko ..... 55/138

FOREIGN PATENT DOCUMENTS 675300 2/1930 France ..... 55/145
267323 1/1971 U.S.S.R. ..... 55/484

*Primary Examiner*—Bernard Nozick
*Attorney, Agent, or Firm*—L. E. Carnahan; Henry P. Sartorio; Judson R. Hightower

[57] ABSTRACT

An electric disk filter provides a high efficiency at high temperature. A hollow outer filter of fibrous stainless steel forms the ground electrode. A refractory filter material is placed between the outer electrode and the inner electrically isolated high voltage electrode. Air flows through the outer filter surfaces through the electrified refractory filter media and between the high voltage electrodes and is removed from a space in the high voltage electrode.

11 Claims, 3 Drawing Figures

DISK FILTER

The United States Government has rights in this invention pursuant to Contract No. W-7405-ENG-48 between the U.S. Department of Energy and the University of California, for the operation of Lawrence Livermore National Laboratory.

BACKGROUND OF THE INVENTION

The invention relates to air filters and more particularly to electric air filters.

High efficiency particulate air (HEPA) filters are utilized in a number of different industries including the nuclear industry to prevent chemical contamination. In various applications, these filters should allow for recovery of collected dust and have less than 10 grams of residual deposit when the filter is discarded. The filter should operate at high temperatures and have high strength. The filters should have high efficiency at high flow rates. The filter designs should also be as compact as possible to lessen the impact on the overall system design.

The high efficiency of the HEPA filters results from the small size of the fibers utilized. However, adhesive used to bond the glass fibers together limits the temperature; HEPA filters are not operative at high temperatures over 300° C. Even if the glass fibers were held together by sandwiching between high temperature resistance screens, the micro glass fibers have a relatively low melting point. For high temperature filtration, refractory fibers must be used. Unfortunately, they do not have sufficiently small fiber diameters for high efficiency air cleaning. However the efficiency of the filter mat made from high temperature resistance, non conducting fibers can be significantly increased by conversion to an electric air filter. An electric air filter removes particles from air electrostatically with a high efficiency and is consequently useful in many applications.

Through cost benefit analysis and field evaluations the most cost effective filtration system was determined to have a very high efficiency while providing the capability of being cleaned many times prior to its disposal. However, provided that the filter can be repeatedly cleaned the dust holding capacity does not have to be very high. Also, since high efficiency filter media have a high pressure drop the filter design must accomodate a large filtering surface. To accomodate a large filter surface within a relatively small volume the filter media must be packaged in a configuration that places the filtering surfaces in close proximity of each other. Unfortunately, packaging a large filter surface in a relatively small volume does not allow recovery of deposited material. As an example, the conventional HEPA filters utilize a pleated configuration of the filter media which makes the filtering surface inaccessible for filter cleaning since the pleats cannot be separated for cleaning.

Accordingly, it is an object of the invention to provide a high temperature electric air filter.

It is also an object of the invention to provide an electric air filter with high efficiency at high temperature over 300° C.

It is a further object of the invention to provide a high temperature electric air filter having a maximum filtering surface which can be readily cleaned.

It is also an object of the invention to provide a high temperature electric air filter in which adjacent filter sheets can be separated during a cleaning cycle.

It is another object of the invention to provide a high efficiency electric air filter which can be cleaned many times prior to its disposal.

SUMMARY OF THE INVENTION

The ivention is an electric disk filter. A plurality of the individual disk filters can be stacked together in a common exhaust port to form a compact high efficiency air filter assembly.

The disk filter comprises an outer filter which has a pair of substantially parallel spaced filter surfaces. The outer filter is disk shaped and forms the ground electrode of the electric air filter. The outer filter surface is a smooth tightly woven screen or a sintered fibrous or powder stainless-steel or other metallic filter which allows deposits to be readily removed by brushing or other mechanical means. A fibrous filter made from refractory fibers (e.g., alumina Saffil media) is mounted inside the stainless-steel filter to increase the filtering efficiency. A fibrous alumina mat nearly covers each surface of the grounded outer electrode. A high voltage electrode, e.g., a pair of spaced metal grids, is mounted inside and electrically insulated from the ground electrode, enclosing the layers of alumina filter there between. A grounded exterior ring and grounded interior exhaust flange are mounted to the ground electrode thereby completing the disk assembly. The high voltage electrode is insulated from the exterior ring and interior exhaust flange, e.g., by means of ceramic or other high temperature insulating material.

The high voltage electrode provides the hollow space in the disk filter through which the filtered exhaust flows. Slots are provided in the central exhaust flange so that the filtered exhaust exits the disk filter. Air flows in through the surfaces of the outer filter, where a substantial amount of particles are removed, and through the alumina mat between the electrodes to remove more of the particles, resulting in a very high efficiency.

DETAILED DESCRIPTION OF THE PREFERRED EMBODIMENT

Figure 1:
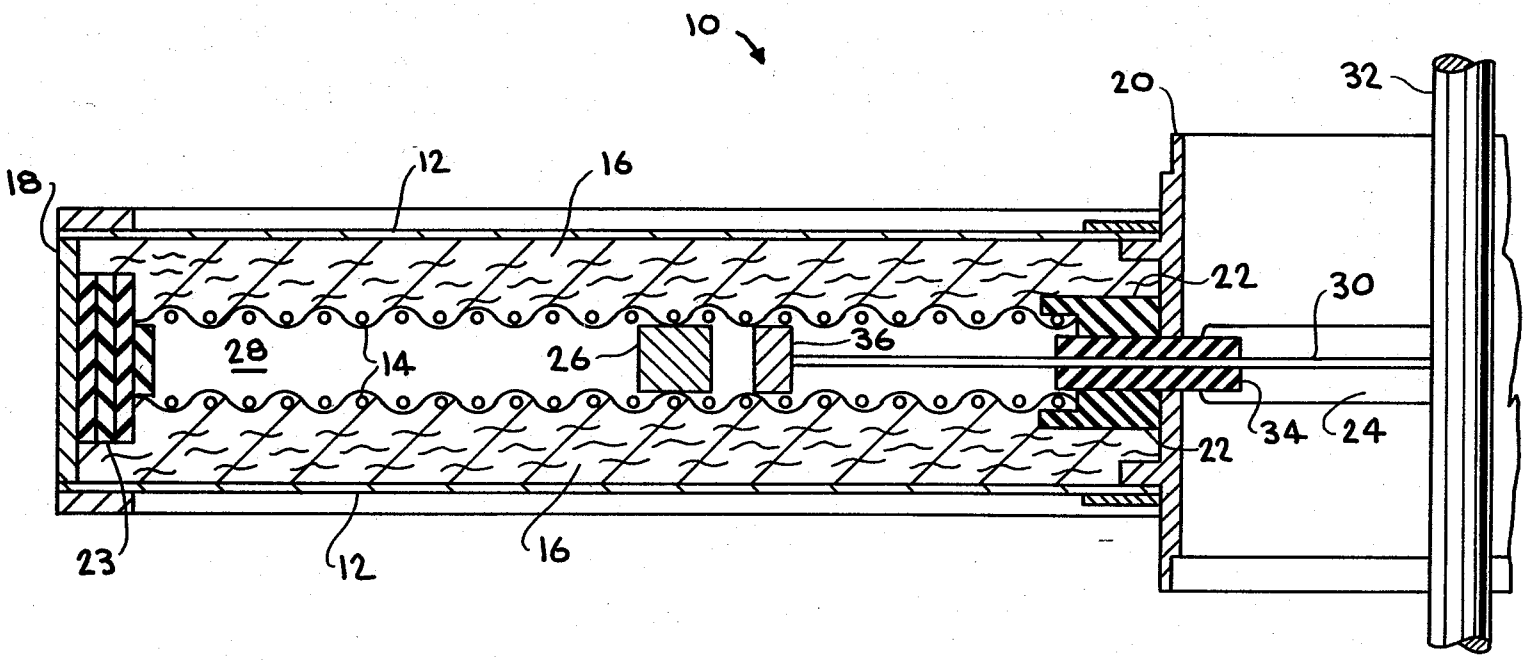
FIG. 1 shows an electric disk filter.

As shown in FIG. 1 an electric disk filter 10 comprises a pair of disk shaped filter surfaces 12 which are mounted together in a spaced parallel relationship and form the ground electrodes. The filter surfaces 12 contain a hollow high voltage electrode 14 mounted between and electrically isolated from the ground electrodes 12. The high voltage electrode 14 is formed of a pair of spaced parallel metal grids. A layer 16 of fibrous filter media is placed on each side of the high voltage electrode 14 between the high voltage electrode 14 and ground electrodes 12.

The ground electrodes 12 are formed of a suitable filter media so that contaminated air is first filtered by passing through these surfaces and into the hollow interior formed by the ground electrodes 12. The outer filter surface must meet high temperature requirements and must be smooth to allow deposits to be readily removed. The outer filter surface also should have as high efficiency as possible so the particles build up on the surface rather than penetrating deep inside the media. The surface filter also has to be structurally strong to withstand repeated cleanings without breaking off any of the filter media. In one preferred embodiment the ground electrode 12 is formed of a sintered fibrous stainless-steel filter; a suitable filter of this type is available from the Bakaert Company, Belgium. The air is further filtered by passing through the layers of fibrous material 16.

In order to produce maximum efficiency, a high voltage electrode 14 is disposed between the ground electrodes 12 to produce an electric air filter in order to remove any contaminants which have not been removed by the filter media forming ground electrodes 12. Applying high D.C. voltage will electrify the refractory fiber media and significantly increase its efficiency. Typically, a voltage of about 5–10 kV is applied to high voltage electrode 14 in order to electrify the refractory filter media. The high voltage electrode 14 is typically formed of a pair of spaced parallel metallic grids. A soft porous refractory filter media is placed in the space between the high voltage grid 14 and grounded grid 12 to further increase efficiency. In a preferred embodiment a filter material 16 made from alumina fibers (Saffil media) is utilized; other ceramic or quartz fibers can be utilized.

The electric disk filter 10 is completed by attaching the grounded electrodes 12 to a grounded exterior ring 18, e.g., by welding. The grounded electrodes 12 are also mounted to a grounded interior exhaust flange 20. The high voltage electrode 14 is electrically insulated from the exterior ring 18 and interior exhaust flange 20 by insulators 23 and 22, respectively, e.g. ceramic rings. Spacers 26 may also be provided to separate the pair of grids of high voltage electrode 14.

The exhaust flange 20 comprises a cylindrical metal tube passing through the center of disk filter 10. A plurality of slots 24 are formed in the exhaust flange 20 so that exhaust flange 20 communicates with the space 28 between the spaced grids of high voltage electrode 14. Pumping means (not shown) are connected to exhaust flange 20 and air flows, as shown in FIG. 1, through filter surface 12 through filter material 16, and into exhaust flange 20.

Electrical leads 30 from high voltage cable 32 which passes through exhaust flange 20 are connected through insulator 34 in flange 20 to electrical contact 36 which contacts high voltage electrode 14 in order to apply a high voltage to electrode 14.

Figure 2:
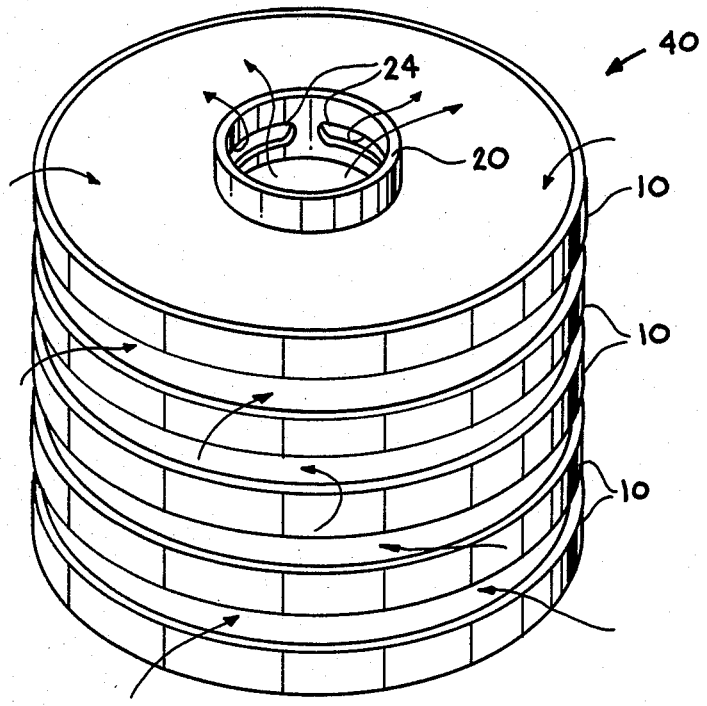
FIG. 2 shows a plurality of electric disk filters as shown in FIG. 1 stacked together to form an air filter assembly.

As shown in FIG. 2, a plurality (e.g., five), of disk filters 10 can be arranged in a stack to form stacked air filter 40. The exhaust flanges 20 (shown in FIG. 1) are designed to allow easy coupling of individual disk filters 10, e.g., by means of mating flanges at the ends of exhaust flange 20. The disk filters 10 are kept in a spaced apart relationship so that air flows into the spacers between individual disk filter 10 and through the disk filter surfaces. The exhaust flanges 20 connect to form a common exhaust.

In one preferred embodiment of disk filter 10, the diameter of the disk is about 12 in., the diameter of the exhaust flange is about 4 in., and the thickness of the disk is about 1 in., and the length of the exhaust flange is about 2 in. Thus, when stacked, there is about a 1 in. spacing between disks.

Figure 3:
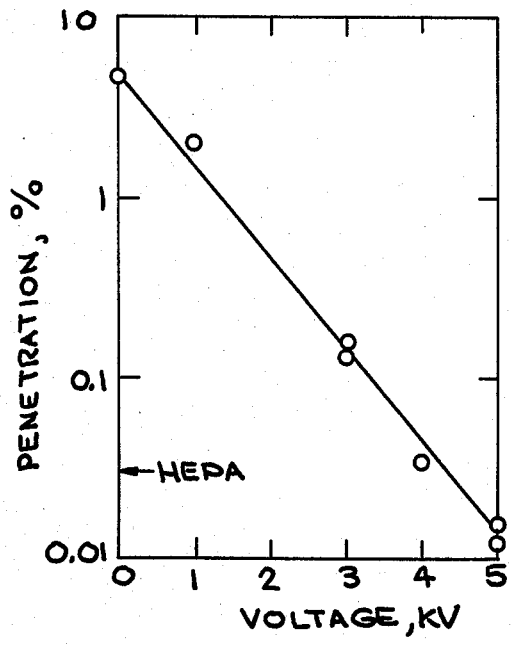
FIG. 3 shows the performance (penetration percent) of the electric disk filter as a function of applied voltage.

The performance of the electric disk filter (a single disk) is shown in FIG. 3. Filter penetration is measured as a function of applied voltage using heterodisperse NaCl aerosols and a light scattering photometer. The performance is measured at a flow rate of 20 cfm (a velocity of 7.3 cm/s). The pressure drop across the filter is 1.08 in. of water. With no applied voltage the filter has a penetration of 5%. Increasing the applied voltage produces a logarithmic decrease in penetration. At 5 kV the penetration is reduced to 0.02% which is comparable to or better than a HEPA filter but at a temperature at which the HEPA filters are unavailable. The high efficiency results from the combination of elements according to the invention. The fibrous stainless steel outer filter has an efficiency of only about 60%. But in combination with the internal alumina filter and the electric filter, an efficiency of about 99.98% is reached.

Changes and modifications in the specifically described embodiments can be carried out without departing from the scope of the invention which is intended to be limited only by the scope of the appended claims.

I claim:

1. An electric air filter comprising:

a hollow porous metallic outer filter having a disk shape and forming a ground electrode;

a porous fiber inner filter mounted inside the outer filter;

a hollow high voltage metal grid electrode mounted inside and electrically insulated from the ground electrode, the porous fiber inner filter being placed between the high voltage and ground electrode, and an air outlet inwardly of the metal grid electrode.

2. The filter of claim 1 wherein the outer filter comprises a pair of spaced parallel filter surfaces.

3. The filter of claim 1 wherein the outer filter is a sintered fibrous stainless-steel filter.

4. The filter of claim 1 wherein the high voltage electrode comprises a pair of spaced parallel metal grids.

5. The filter of claim 1 further including a high voltage source electrically connected to the high voltage electrodes.

6. An electric air filter assembly comprising a plurality of electric air filters according to claim 1 arranged in a stack.

7. The filter of claim 1 wherein the inner filter is a refractory porous material.

8. The filter of claim 7 wherein the inner filter is an alumina fibrous material.

9. The filter of claim 1 further including an exterior ring and interior exhaust flange mounted to the ground electrode.

10. The filter of claim 9 wherein the interior exhaust flange contains a plurality of ports communicating between the interior of the exhaust flange and the interior of the hollow outer filter.

11. An electric air filter assembly comprising a plurality of electric air filters according to claim 10 arranged in a stack, the exhaust flanges of each filter being connected to each other to form a common exhaust.

* * * * *